US005974828A

United States Patent [19]

Guerand

[11] Patent Number: 5,974,828

[45] Date of Patent: Nov. 2, 1999

[54] CONDENSER WITH REMOVABLE RESERVOIR FOR A REFRIGERATION CIRCUIT, IN PARTICULAR

[75] Inventor: Michel Guerand, Saint Soupplets, France

[73] Assignee: Valeo Thermique Moteur, La Verriere, France

[21] Appl. No.: 08/956,848

[22] Filed: Oct. 23, 1997

[30] Foreign Application Priority Data

Oct. 23, 1996 [FR] France ..... 96 12913

[51] Int. Cl.[6] ..... F25B 39/04

[52] U.S. Cl. ..... 62/509; 62/507

[58] Field of Search ..... 62/502, 509, 507, 62/512, 471, 474

[56] References Cited

U.S. PATENT DOCUMENTS

| | | | |
|---|---|---|---|
| 3,759,062 | 9/1973 | Wrenn et al. . | |
| 3,785,164 | 1/1974 | Wrann, Jr. . | |
| 3,810,366 | 5/1974 | Orth . | |
| 5,224,358 | 7/1993 | Yamanaka et al. | 62/509 |
| 5,365,751 | 11/1994 | Mikesell et al. . | |
| 5,505,253 | 4/1996 | Heraud | 165/110 |
| 5,685,364 | 11/1997 | Harris | 165/67 |
| 5,709,106 | 1/1998 | Inaba et al. | 62/507 |

FOREIGN PATENT DOCUMENTS

| | | |
|---|---|---|
| 0 480 330 | 4/1992 | European Pat. Off. . |
| 2 194 920 | 3/1974 | France . |
| 2 359 386 | 2/1978 | France . |
| 34 16 304 | 11/1995 | Germany . |
| 683356 | 3/1994 | Switzerland . |
| 95/03110 | 7/1994 | WIPO . |

OTHER PUBLICATIONS

Patent Abstracts of Japan vol. 016, No. 395 (M–1299), Aug. 21 1992 & JP 04 131667 (Hitachi), May 6, 1992.

*Primary Examiner*—William Doerrler
*Attorney, Agent, or Firm*—Morgan & Finnegan LLP

[57] ABSTRACT

The invention concerns a condenser for a refrigeration circuit able to have passing through it a refrigeration fluid and comprising a removable reservoir connected to a header of the condenser and able to have the refrigeration fluid passing through it.

The reservoir is produced in the form of a replaceable cartridge provided with a connection able to cooperate with a base of conjugate shape which is fixed to the header and connected to the latter by an inlet manifold and an outlet manifold for the refrigeration fluid.

Application notably to air conditioning installations for motor vehicles.

23 Claims, 2 Drawing Sheets

CONDENSER WITH REMOVABLE RESERVOIR FOR A REFRIGERATION CIRCUIT, IN PARTICULAR

BACKGROUND OF THE INVENTION

The invention concerns a condenser designed to form part of a refrigeration circuit, in particular in an air conditioning installation for a motor vehicle.

It concerns more especially a condenser able to have passing through it a refrigeration fluid and comprising a removable reservoir connected to a header of the condenser and able to have the refrigeration fluid passing through it.

In a refrigeration circuit of this type, the refrigeration fluid is sent, in superheated vapour phase, under the action of a compressor to the condenser, in which it is successively cooled or "de-superheated", condensed to a hot liquid phase, then "sub-cooled" to a cold liquid phase.

The refrigeration fluid thus condensed and cooled is then sent, via a pressure reducing valve, to an evaporator where it exchanges heat with a flow of air to be sent into the passenger compartment of the vehicle. In this evaporator, the refrigeration fluid is transformed to the vapour phase, while the flow of air is cooled, thereby enabling conditioned air to be supplied. The refrigeration fluid in the vapour phase then leaves the evaporator to enter the compressor, and so on.

A condenser of this type normally comprises a bank of tubes mounted between two headers, so that the condensation and then cooling of the condensed refrigeration fluid take place as the latter moves through the tubes in the bank.

From EP-A-0 480 330, a condenser of this type is already known in which the reservoir is removable and is furthermore connected at an intermediate point to the bank situated between a first part of the bank where the refrigeration fluid is condensed, and a second part of the bank where the condensed refrigeration fluid is sub-cooled.

This reservoir is designed to collect some of the hot condensed refrigeration fluid in order to sub-cool it and separate the liquid and vapour phases of the refrigeration fluid, which is then sub-cooled further in the second part of the bank.

Furthermore, this reservoir normally contains a desiccating product to dehydrate the refrigeration fluid.

In the condenser known from the publication EP-A-0 480 330, the reservoir has a receiving part which is able to cooperate with an adaptation part provided on the header of the condenser, these two parts being fixed by a screw-type fixing means.

There results the drawback that, where the reservoir needs to be replaced, it is necessary to replace the whole assembly formed by the reservoir proper and the receiving part with which it is integral.

Furthermore, this known reservoir is particularly bulky.

It should also be emphasised that, in this known condenser, the options for the location and orientation of the reservoir are limited.

The result is that a single condenser can be used in each case only for a closely-defined type of vehicle.

The invention aims notably to overcome the aforementioned drawbacks.

SUMMARY OF THE INVENTION

It proposes to this end a condenser of the type defined in the introduction, in which the reservoir is produced in the form of a replaceable cartridge provided with a connection able to cooperate with a base of conjugate shape which is fixed to the header and connected to the latter by an inlet manifold and an outlet manifold for the refrigeration fluid.

Thus, if the reservoir needs to be replaced, it suffices simply to remove the cartridge and replace it with another cartridge, without working on the base, which remains fixed to the header.

Furthermore, as this base is connected to the header by two pipes, it is possible to cause these two pipes to open out at selected points of the header and also to give the base, and hence the cartridge, a chosen orientation.

Consequently, a single condenser is able to offer a multiplicity of location positions for the reservoir.

According to another characteristic of the invention, the connection of the cartridge comprises a hollow axial connecting piece able to be received in an axial housing in the base.

Advantageously, this axial connecting piece is attached to a perforated bottom able to be received in an annular housing in the base which surrounds the axial housing of the base.

According to another characteristic of the invention, the annular housing and the axial housing of the base communicate in one case with the inlet pipe and in the other case with the outlet pipe for refrigeration fluid.

Thus, when the cartridge is positioned in the base, the refrigeration fluid is able to pass through the cartridge.

Advantageously, the annular housing and the axial housing of the base communicate respectively with the inlet pipe and outlet pipe. As a result, the refrigeration fluid enters the annular housing, then goes inside the cartridge through the perforated bottom and finally leaves the cartridge through the hollow axial connecting piece.

In a preferred embodiment of the invention, the axial connecting piece of the cartridge has an external thread able to cooperate with an internal thread on the axial housing of the base, thereby enabling the cartridge to be fixed by simple screwing.

Of course, other methods of fixing the connecting piece may be envisaged.

In one embodiment, the inlet manifold and outlet manifold are produced of a single piece with the base. In another embodiment, the inlet manifold and outlet manifold are connected to the base by brazing.

Advantageously, the connection of the cartridge includes an external circular cylindrical wall able to be received in an internal circular cylindrical wall of the base, with at least one annular sealing joint interposed.

The cartridge can assume various forms.

Advantageously, it comprises a cylindrical tube, one end of which is connected to the connection and another end of which is connected to a plug.

Advantageously, the tube, connection and plug are connected together by brazing.

According to another characteristic of the invention, the cartridge contains a desiccating product.

The invention applies in particular to a condenser in which the header is connected to a bank of tubes. Advantageously, the inlet manifold and outlet manifold open into two adjacent compartments of the header which communicate respectively with a part of the bank serving to condense the refrigeration fluid and a part of the bank serving to sub-cool the condensed refrigeration fluid.

According to a further characteristic of the invention, the base and the cartridge lie along a director axis which can be given a selected angle and position with respect to the header.

BRIEF DESCRIPTION OF THE DRAWINGS

In the description which follows, given solely by way of example, reference is made to the accompanying drawings, in which.

DETAILED DESCRIPTION OF THE PREFERRED EMBODIMENTS

Figure 1:
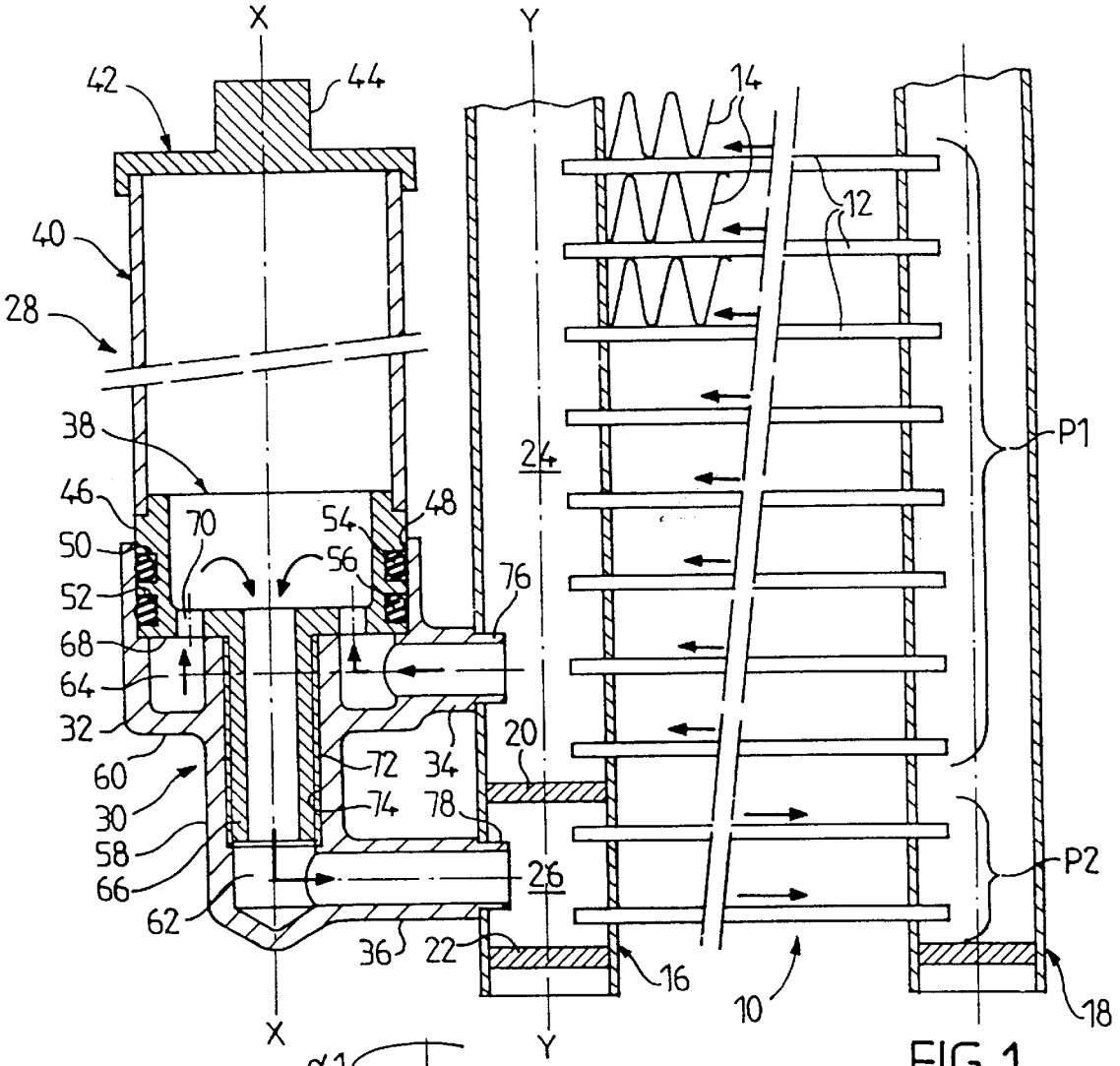
FIG. 1 is a view in partial cross section of a condenser equipped with a removable reservoir according to a first embodiment of the invention.

Reference is first made to FIG. 1, which depicts a condenser able to form part of an air conditioning installation for a motor vehicle.

The condenser comprises a bank 10 formed by a multiplicity of flat tubes 12 between which there are positioned dividers 14, of corrugated form overall, forming heat exchange fins.

The bank 10 is mounted between two headers 16 and 18 which are tubular in shape, with a circular cross section, and have parallel axes, according to well-known technology.

The header 16 is notably provided with an internal wall 20 and an end wall 22, which defines an upper compartment 24 and lower compartment 26.

The condenser is able to have passing through it a refrigeration fluid in a multi-pass flow, as shown by the arrows. Thus the refrigeration fluid circulates in particular in a first part P1 (or upstream part) of the bank in which the refrigeration fluid arriving in superheated vapour phase is successively cooled or "de-superheated" and condensed.

Then the previously condensed refrigeration fluid circulates in a final part P2 of the bank (downstream part) in which the condensed refrigeration fluid is sub-cooled.

The condenser also comprises a reservoir 28 which communicates with the upper compartment 24 and the lower compartment 26 of the header 16 and which is designed to have refrigeration fluid passing through it.

The removable cartridge 28 is received in a base 30 having a body 32 whose overall shape is formed by rotation about an axis XX and two manifolds 34 and 36 which each extend in a direction substantially radial with respect to the axis XX. The manifold 34 opens out in the upper compartment 24 and forms an inlet manifold for the refrigeration fluid, while the manifold 36 opens out into the lower compartment 26 and forms an outlet manifold for the refrigeration fluid.

The cartridge 28 essentially comprises three parts: a connection 38 able to cooperate with the base 30, a tube 40, one end of which is fitted to the connection 38, and a plug 42 which is fitted to the other end of the tube 40.

Advantageously, the connection 38, the tube 40 and the plug 42 are metal parts, for example made of aluminium-based alloys, and are connected together by brazing.

The plug 42 ends in a head 44 which forms a gripping and optionally tightening or loosening device for the cartridge. Although the plug 42 is advantageously permanently fitted to the tube 40, it might be envisaged, in a variant, to be able to remove it from the tube 40.

The connection 38 and base 30 have conjugate shapes to assist their fitting together.

The connection 38 of the cartridge has an external circular cylindrical wall 46 able to be received in an internal circular cylindrical wall 48 of the base. In the wall 46 there are formed two annular grooves 50 and 52 able to receive two O-ring seals 54 and 56.

The cylindrical wall 48 of the base 30 continues in a coaxial cylindrical shaft 58 which is connected to the wall 48 by an annular part 60.

The manifolds 34 and 36 open out respectively in the cylindrical part 48 and in the shaft 58 of the base 30.

The base 30 defines a blind axial housing 62 which communicates with the outlet manifold 36 and an annular housing 64 which communicates with the inlet manifold 34.

The connection 38 also has a hollow axial connecting piece 66 which is connected to the cylindrical wall 46 by an annular perforated bottom 68. This perforated bottom is provided with one or more openings 70 which cause the inside of the cartridge to communicate with the annular housing 64 when this cartridge is received in the base.

When the axial connecting piece 66 is received in the axial housing 62, the connection 38 is sealingly connected to the base and the refrigeration fluid is able to circulate successively from the upper compartment 24 to the annular housing 64 passing through the inlet manifold 34. Next the refrigeration fluid reaches the inside of the cartridge 28 and then leaves the latter through the hollow axial connecting piece 66 and through the outlet manifold 36 to reach the lower compartment 26.

In the example embodiment depicted, the axial connecting piece 66 is provided with an external thread 72 able to cooperate with an internal thread 74 on the axial housing 62 of the base.

The cartridge 28 is designed to contain a desiccating product (not shown) to dehydrate the refrigeration fluid. In the embodiment in FIG. 1, the base 30, including the manifolds 34 and 36, is produced of a single piece, for example by stamping a metal, advantageously an aluminium alloy.

The manifolds 34 and 36 have free ends 76, 78 with a smaller diameter, able to be engaged in suitable openings formed in the wall of the header 16.

It will be understood that the openings can be produced at selected locations in the header 16, in particular in a selected angular position (see the angle $\alpha 1$ in FIG. 2) with respect to the axis YY of the header 16. The angle $\alpha 1$ can vary from 0 to 180°.

Figure 2:
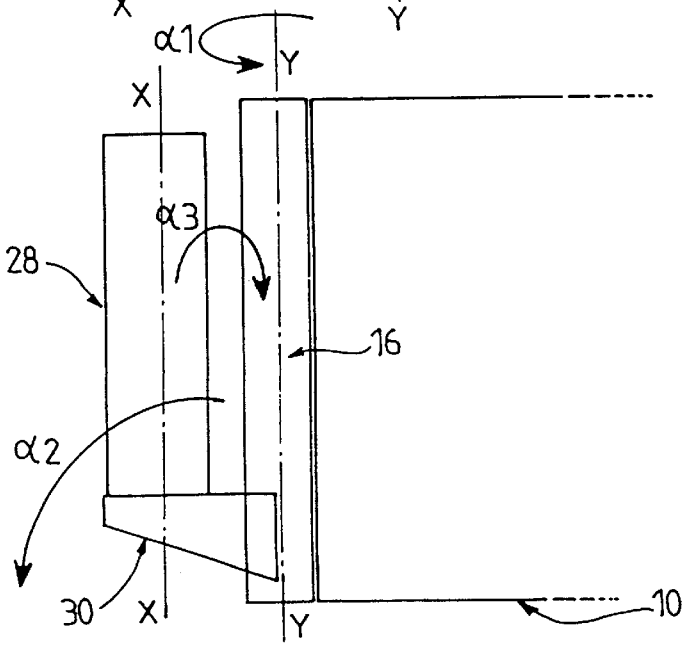
FIG. 2 is a diagrammatic depiction of the condenser and reservoir in FIG. 1 showing the various positions of the reservoir.

Furthermore, the manifolds 34 and 36 can be disposed in a non-radial position with respect to the axis of the axial housing 62 in order to incline the cartridge to a greater or lesser extent with respect to the axis YY, as shown by the angle $\alpha 2$ in FIG. 2.

In this regard, the angle $\alpha 2$ can vary between 0 and 90° with respect to the generating lines of the header.

Finally, it is possible to vary the position of the cartridge by causing it to pivot by an angle $\alpha 3$ of ±90° with respect to the generating lines of the header, as also shown in FIG. 2.

Thus it will be understood that it is possible to give a multiplicity of positions or orientations to the cartridge 28, either depending on the position of the reception holes of the pipes, or depending on the configuration of the base.

The cartridge 28 contains only condensed refrigeration fluid at low temperature and compensates for variations in the volume of refrigeration fluid in the circuit, while dehydrating the refrigeration fluid.

If the cartridge 28 is to be exchanged, it simply needs to be unscrewed by actuating its head 44, which can for example be produced in the form of a hexagonal head, and then replaced with a new cartridge.

Figure 3:
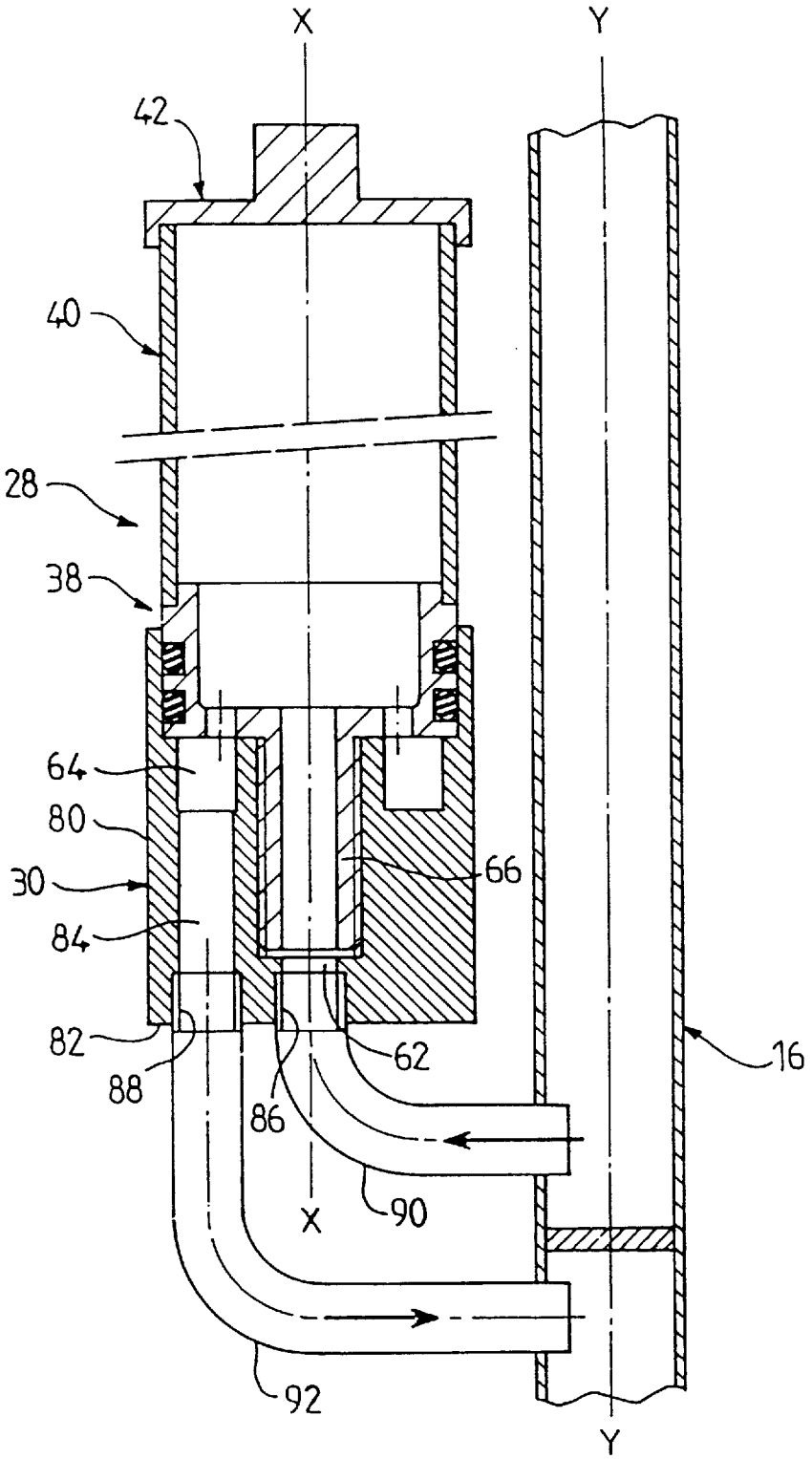
FIG. 3 is a view similar to the one in FIG. 1 in another embodiment.

Reference will now be made to FIG. 3, which shows another variant embodiment of the invention.

In this variant, the cartridge 28 is strictly identical to the cartridge 28 in FIG. 1.

The base 30, on the other hand, has a cylindrical body 80 in which there are formed the axial housing 62 and the annular housing 64.

The axial housing 62, on the other hand, rather than being blind, opens out on an end face 82 of the body 80.

Furthermore, another axial bore 84, which extends parallel to the axial housing 62, opens out into the annular housing 64 and into the end face 82. In the vicinity of their opening out on the end face 82, the axial housing 62 and the bore 84 have enlarged parts, respectively 86 and 88. These enlarged parts are designed to receive the ends of the two manifolds 90 and 92 used respectively for the refrigeration fluid inlet and outlet.

The manifolds 90 and 92 are therefore independent of the connection. They each have a first end which is advantageously connected by brazing to the base 30 and a second end which is also advantageously connected by brazing to the wall of the header 16.

The manifolds 90 and 92 can be angled in an appropriate fashion to give a chosen orientation to the base 30 and, consequently, to the cartridge 28.

It should be noted that, in FIG. 3, the tubes 12 of the condenser have not been shown, in order to simplify the drawing.

The operation of the cartridge 28 in FIG. 3 is similar to that of the cartridge 28 in FIG. 1.

It should be noted that the same cartridge can be used both in the base 30 in FIG. 1 and in the base 30 in FIG. 3.

Of course, the invention is not limited to the embodiments described previously by way of example.

Thus it is possible to use bases with different configurations, so long as they enable the connection of the cartridge to be received.

Also, the cartridge could, as a variant, be provided with a removable plug to enable only its desiccating product to be replaced, if necessary.

Finally, although the invention has been described in a preferred application to an air conditioning installation for a motor vehicle, it should be understood that it can be used in other refrigeration circuits.

I claim:

1. A condenser comprising:

a removable reservoir produced in the form of a replaceable cartridge, the reservoir capable of being connected to a header of the condenser and capable of having a refrigeration fluid passing through it;

a base;

the replaceable cartridge provided with a connection capable of cooperating with the base of conjugate shape, the connection having a hollow axial connecting piece capable of being received in an axial housing in the base, wherein the axial connecting piece attached to a perforated bottom capable of being received in an annular housing in the base which surrounds an axial housing of the base;

the base is fixed to the header and communicates with the header by an inlet manifold and an outlet manifold for the refrigeration fluid; and wherein the annular housing and the axial housing of the base communicate with the inlet pipe and outlet pipe, respectively, so that the refrigeration fluid enters the annular housing, goes inside the cartridge through the perforated bottom and exits the cartridge through the hollow axial connecting piece.

2. A condenser according to claim 1, wherein the axial connecting piece of the cartridge has an external thread capable of cooperating with an internal thread on the axial housing in the base.

3. A condenser according to claim 1, wherein the inlet manifold and outlet manifold are produced of a single piece with the base.

4. A condenser according to claim 1, wherein the inlet manifold and outlet manifold are connected by brazing to the base.

5. A condenser according to claim 1, wherein the connection of the cartridge includes an external circular cylindrical wall capable of being received in an internal circular cylinderical wall of the base, with at least one annular sealing joint interposed.

6. A condenser according to claim 1, wherein the cartridge comprises a cylindrical tube, one end of which is connected to the connection and another end of which is connected to a plug.

7. A condenser according to claim 6, wherein the tube, connection and plug are connected together by brazing.

8. A condenser according to claim 1, wherein the cartridge contains a desiccating product.

9. A condenser according to claim 1, in which the header is connected to a bank of tubes, wherein the inlet manifold and the outlet manifold open into two adjacent compartments of the header, which communicate respectively with a part of the bank serving to condense the refrigeration fluid and a part of the bank serving to sub-cool the condensed refrigeration fluid.

10. A condenser according to claim 1, wherein the base and the cartridge have a director axis which can be given a selected angle and position with respect to the header.

11. A condenser comprising:

a header;

a connection in communication with a base of conjugate shape, wherein the base is connected to the header by an inlet manifold and an outlet manifold;

a plug having a head; and a reservoir having a cylindrical tube, one end of which is connected to the connection, and another end which is connected to the plug, wherein the reservoir is capable of being removed by actuating the head of the plug.

12. A condenser according to claim 11, wherein the connection comprises a hollow axial connecting piece capable of being received in an axial housing in the base.

13. A condenser according to claim 12, wherein the axial connecting piece is attached to a perforated bottom capable of being received in an annular housing in the base, wherein the annular housing surrounds the axial housing.

14. A condenser according to claim 13, wherein the annular housing and the axial housing communicate with the inlet manifold and the outlet manifold.

15. A condenser according to claim 13, wherein the annular housing and the axial housing communicate with the inlet manifold and outlet manifold, respectively, wherein refrigeration fluid enters the annular housing, travels inside the reservoir through the perforated bottom, and exits the reservoir through the hollow axial connecting piece.

16. A condenser according to claim 15, wherein the axial connecting piece of the cartridge has an external thread capable of cooperating with an internal thread on the axial housing in the base.

17. A condenser according to claim 15, wherein the inlet manifold and outlet manifold are produced of a single piece with the base.

18. A condenser according to claim 17, wherein the inlet manifold and outlet manifold are connected by brazing to the base.

19. A condenser according to claim 15, wherein the connection of the cartridge includes an external circular cylindrical wall capable of being received in an internal circular cylindrical wall of the base, with at least one annular sealing joint interposed.

20. A condenser according to claim 11, wherein the tube, connection and plug are connected together by brazing.

21. A condenser according to claim 20, wherein the cartridge contains a desiccating product.

22. A condenser according to claim 11, in which the header is connected to a bank of tubes, wherein the inlet manifold and the outlet manifold open into two adjacent compartments of the header, which communicate respectively with a part of the bank serving to condense the refrigeration fluid and a part of the bank serving to sub-cool the condensed refrigeration fluid.

23. A condenser according to claim 15, wherein the base and the cartridge have a director axis which can be given a selected angle and position with respect to the header.

* * * * *